US008430242B2

(12) United States Patent
DiMauro

(10) Patent No.: US 8,430,242 B2
(45) Date of Patent: Apr. 30, 2013

(54) PACKAGING SYSTEM AND METHOD

(76) Inventor: Paul DiMauro, Oxford, CT (US)

( * ) Notice: Subject to any disclaimer, the term of this patent is extended or adjusted under 35 U.S.C. 154(b) by 0 days.

(21) Appl. No.: 13/357,134

(22) Filed: Jan. 24, 2012

(65) Prior Publication Data

US 2013/0020228 A1 Jan. 24, 2013

Related U.S. Application Data

(62) Division of application No. 12/414,846, filed on Mar. 31, 2009, now Pat. No. 8,122, 690.

(60) Provisional application No. 61/041,633, filed on Apr. 2, 2008.

(51) Int. Cl.
*B65D 81/02* (2006.01)
*B65D 85/30* (2006.01)

(52) U.S. Cl.
USPC ..... 206/453; 206/586; 206/587

(58) Field of Classification Search ..... 206/453, 206/586, 523, 587, 591, 592, 594
See application file for complete search history.

(56) References Cited

U.S. PATENT DOCUMENTS 5,071,009 A * 12/1991 Ridgeway ..... 206/586
7,014,047 B2 * 3/2006 Stapleton ..... 206/586
8,122,690 B2 * 2/2012 DiMauro ..... 53/472
2002/0056656 A1 * 5/2002 Beliveau ..... 206/453
2008/0179216 A1 * 7/2008 Kari ..... 206/586
2009/0241317 A1 * 10/2009 Kubler et al. ..... 29/428
2009/0249752 A1 * 10/2009 DiMauro ..... 53/473
2010/0072096 A1 * 3/2010 Wu et al. ..... 206/453
2012/0031807 A1 * 2/2012 Shimomichi ..... 206/586

* cited by examiner

*Primary Examiner* — Jacob K Ackun
(74) *Attorney, Agent, or Firm* — Michael A. Blake

(57) ABSTRACT

A shipping system comprising: a plurality of edge protectors, each of the edge protectors comprising: a backwall; an upper jaw member in communication with the backwall, the upper jaw member having a top surface; a lower jaw member in communication with the backwall, the lower jaw member having a lower surface, and the lower surface and the top surface are generally flat and parallel to each other; a single slot defined by the upper jaw member and the lower jaw member, and the single slot being generally orthogonal to the backwall, the edge protector having an outer width; at least one u-channel support member, the u-channel support member comprising: a bottom wall; a first sidewall extending generally orthogonally from the bottom wall; a second sidewall extending generally orthogonally from the bottom wall; an interior width between an interior surface of the first sidewall and the interior surface of the second sidewall, and where the interior width is generally equal to the outer width.

6 Claims, 13 Drawing Sheets

PACKAGING SYSTEM AND METHOD

CROSS-REFERENCES

This patent application is a divisional application of patent application Ser. No. 12/414,846, now U.S. Pat. No. 8,122,690, filed on Mar. 31, 2009 by Paul DiMauro, the entire contents of which are fully incorporated by reference herein. Patent application Ser. No. 12/414,846 claims the benefit of provisional patent application Ser. No. 61/041,633, by Paul DiMauro, entitled "Packaging Apparatus and System", filed on Apr. 2, 2008, the entire contents of which are fully incorporated by reference herein.

TECHNICAL FIELD

The field of invention relates to an apparatus and system for packaging fragile items, and specifically relates to an apparatus and system for packaging items such as, but not limited to picture frames, framed art, and mirrors.

BACKGROUND

Moving, shipping, mailing, and storing framed pieces of art, pieces of glass or other generally flat objects which are fragile requires protection for the objects, whether one is moving locally, making a long-distance move, or simply storing the object. Boxes are available in which to pack these objects, and protecting the ends or corners of each object, whether it be a painting or a piece of glass is important. However, current packaging methods still fall short in protecting the object being packaged.

Fragile flat articles, such as framed art, mirrors or the like may be shipped through a small package, LTL, or moving company. Due to vibration, shock and general rough treatment of these packages the fragile article contained in the package may often be broken or damaged during shipment.

While the prior packaging containers have achieved limited success, a major shortcoming remains their lack of versatility for packaging large varieties of articles, and the inadequate protection they provide against damage caused by shipment. Therefore, there is a need for a packaging system which will permit the shipping or storage of flat fragile items, without the damage normally associated with prior art containers.

SUMMARY

The disclosed invention relates to a shipping system comprising: a plurality of edge protectors, each of the edge protectors comprising: a backwall; an upper jaw member in communication with the backwall, the upper jaw member having a top surface; a lower jaw member in communication with the backwall, the lower jaw member having a lower surface, and the lower surface and the top surface are generally flat and parallel to each other; a single slot defined by the upper jaw member and the lower jaw member, and the single slot being generally orthogonal to the backwall, the edge protector having an outer width; at least one u-channel support member, the u-channel support member comprising: a bottom wall; a first sidewall extending generally orthogonally from the bottom wall; a second sidewall extending generally orthogonally from the bottom wall; an interior width between an interior surface of the first sidewall and the interior surface of the second sidewall, and where the interior width is generally equal to the outer width.

The disclosed invention also relates to a method of shipping generally flat items, the method comprising: placing a first u-channel in the bottom of a box; attaching a first pair of edge protectors to opposing ends of an item to be shipped; attaching a second pair of edge protectors to two other opposing ends of the item to be shipped; placing the item to be shipped in the box; attaching the first pair of edge protectors to the u-channel support member in the bottom of the box; attaching a second u-channel support member to the second pair of edge protectors such that the second u-channel support member is perpendicular to the first u-channel support member and on the opposite side of the item from the first u-channel support member; and closing and sealing the box for shipping.

The disclosed invention also relates to a method of shipping generally flat items, the method comprising: attaching a first pair of edge protectors to opposing sides of an item to be shipped; attaching a first u-channel support member to the first pair of edge protectors; and closing and sealing the box for shipping.

BRIEF DESCRIPTION OF THE DRAWINGS

The present disclosure will be better understood by those that have experience in the shipping of flat, fragile items by referencing the accompanying drawings, where like elements are numbered alike in the several figures, in which.

DETAILED DESCRIPTION

Figure 1:
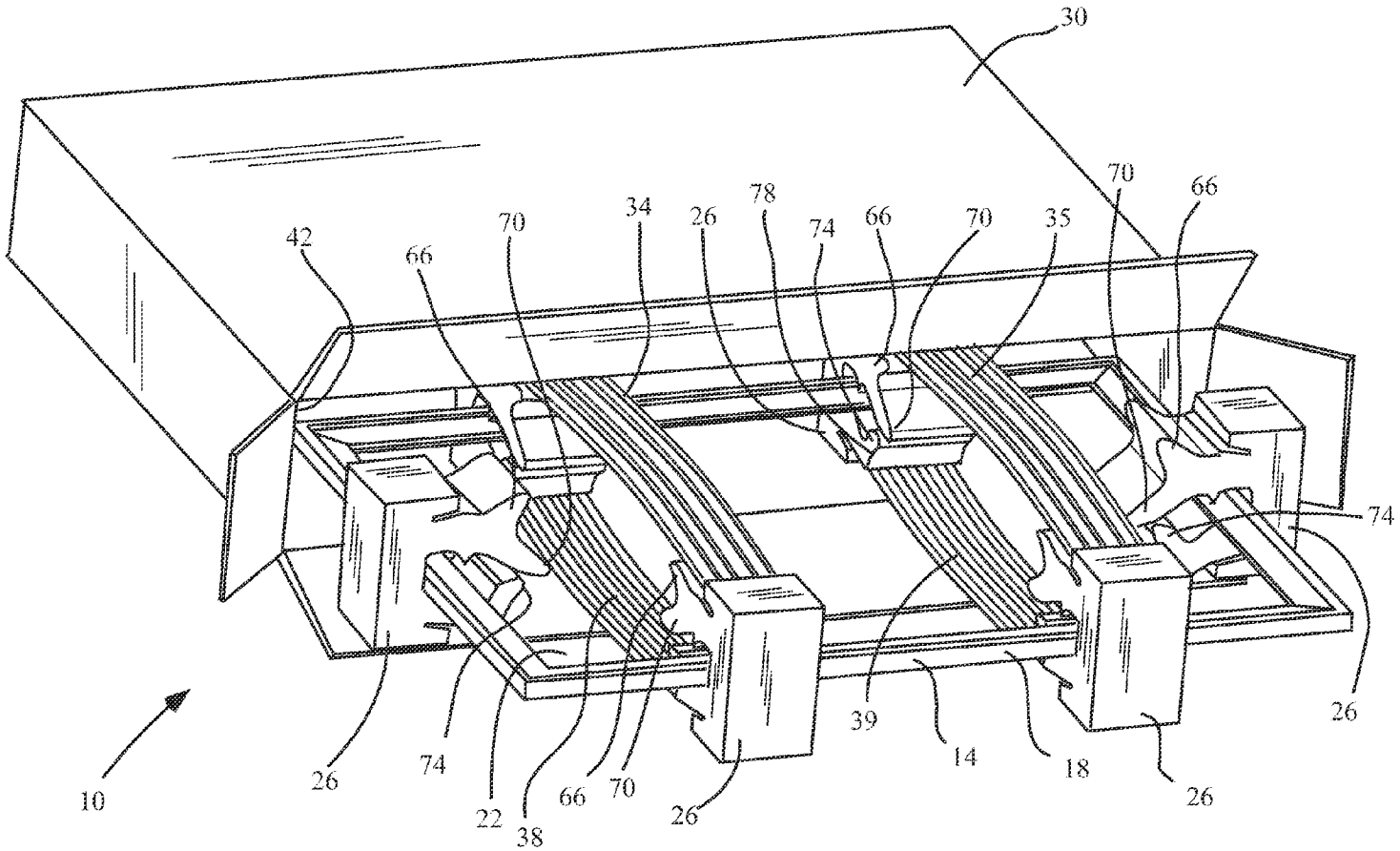
FIG. 1 is a perspective view of the disclosed packaging system.

FIG. 1 is a perspective view of the disclosed packaging system 10. An item 14 is shown being packaged. The item may be any item that requires protection, such as, but not limited to: framed art, mirror, flat screen television, framed diploma, glass pane, unframed art, etc. In FIG. 1, the item 14 is a frame 18 that surrounds a glass center 22. Four (4) energy absorbing edge protectors 26 or clam shell supports (hereinafter referred to as simply edge protectors) are removeably attached to the item 14 (the fourth edge protector is not visible due to its being inside the box 30). The term "clam shell" is only used to identify the supports 26, and no limitations to the support is meant or implied. Attached to a first pair of two (2) opposing edge protectors 26 are a first cross-member 34 and a second cross-member 38. Attached to a second pair of two (2) opposing edge protectors 26 is a third cross-member 35 and a fourth cross-member 39. With the two pairs opposing edge protectors attached to the item 14, and the four cross-members 34, 35, 38, 39 attached to the two pairs of opposing claim shell supports 26, and a fifth and sixth edge protector 26, 26 attached to the item 14, the item, and the six (6) edge protectors 26, and cross-members 34, 38 can be slid into a box 30. It should be noted that some of the edge protectors 26 may be attached to the item after the item 14 is inserted into the box 30. Once the item is slid completely into the box (FIG. 1 shows the item only partially slid into the box 30) the box can be closed and sealed for shipping. In other embodiments, there may be only one (1) pair of opposing edge protectors 26, 26 attached to an item, and a $3^{rd}$ and a $4^{th}$ edge protector attached to the item but without cross-members. The number of edge protectors 26 and cross-members used is entirely dependent on the size of the item 14, and the amount of support the item 14 needs to be suspended within the center of box 30. The cross-members 34, 38, 35, 39 are flexible members that tend to push out away from the item 14 and into the box 30. These cross-members 34, 38, 35, 39 along with the edge protectors 26, tend to "suspend" the item 14 within the center of the volume of the box, thus protecting the item 14 from breaking or damage. The opposing edge protectors 26 and cross-members 34, 38, 35, 39 are shown in a lengthwise orientation to the opening 42 of the box. In another embodiment, the opposing edge protectors 26 and cross-members 34, 38 may be slid into the opening 42 of the box 30 in a transverse orientation to the opening, or in other words, with the item 14 and opposing edge protectors 26 and cross-members 34, 38 rotated 90° along the plane of the item 14.

Figure 2:
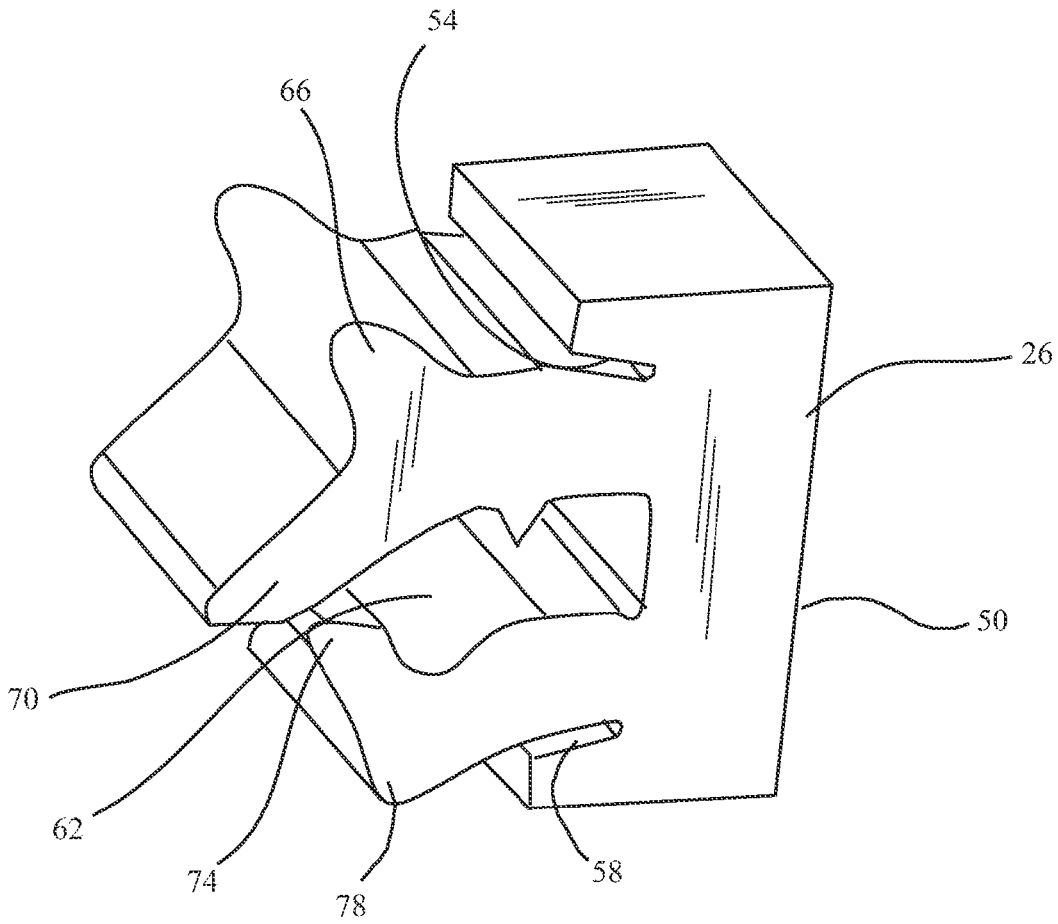
FIG. 2 is a perspective view of a edge protector.

FIG. 2 shows a perspective view of one of the edge protectors 26. The claim shell support comprises a backwall 50, an upper slot 54, a lower slot 58, and a middle slot 62. The edge protector 26 also comprises a first protruding member 66, an upper jaw member 70, a lower jaw member 74, and a second protruding member 78. The upper slot 54 is configured to hold a cross-member 34, and the lower slot 58 is configured to hold a cross-member 38. Referring to FIG. 1 and FIG. 2, it can be seen that when opposing claim shell supports 26 are installed with the cross-members 34, 38 as shown in FIG. 1, the cross-member 34 impinges on the first protruding member 66, thus pushing the upper jaw member down onto the item 14, similarly the cross-member 38 impinges on the second protruding member 78, thus pushing the lower jaw member 74 onto the item 14, thereby snugly holding the item within the middle slot 62. The cross-members 34, 38 are normally straight, but when properly sized, will have an arc or a bow shape as shown in FIGS. 1 and 2. This bow shape tends to push out on the interior of the box 30, thereby protecting the item 14, and also tending to suspend the item 14 within the center of the box 30.

The edge protectors 26 may be made out of any resilient, springy material such as closed cell Styrofoam, rubber, pressed cardboard and high impact polystyrene. The edge protectors 26 will tend to act as spring pushing the out on the cross-members 34, 38 while at the same time grasping the item 14 being packaged. The cross-members 34, 38 may be made out of any relatively rigid material that can bend relatively easy, and withstand forces from other boxes or packages impacting the currently disclosed packaging system that may occur during shipping and storage of packages. Such relatively rigid material may include plastic, pressed cardboard and high impact polystyrene. The cross-members 34, 38 tend to act as a spring, tending to close the edge protectors 26 onto the item being packaged, and tending to push out on the box interior surface.

Figure 5:
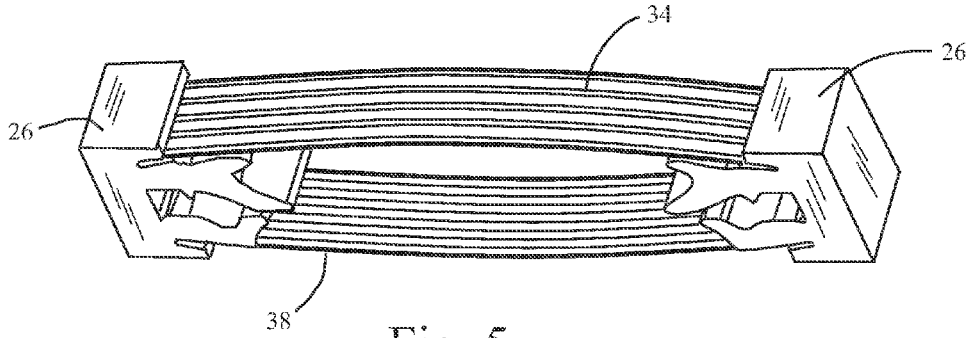
FIG. 5 is a perspective view of the two opposing edge protectors and cross-members inserted into the two opposing edge protectors from FIG. 3.
Figure 4:
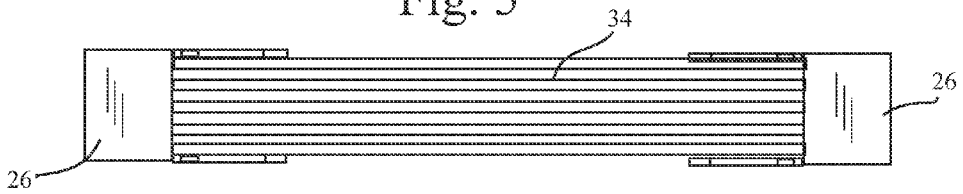
FIG. 4 is a top view of the two opposing edge protectors and a first or third cross-member inserted into the two opposing edge protectors from FIG. 3.
Figure 3:
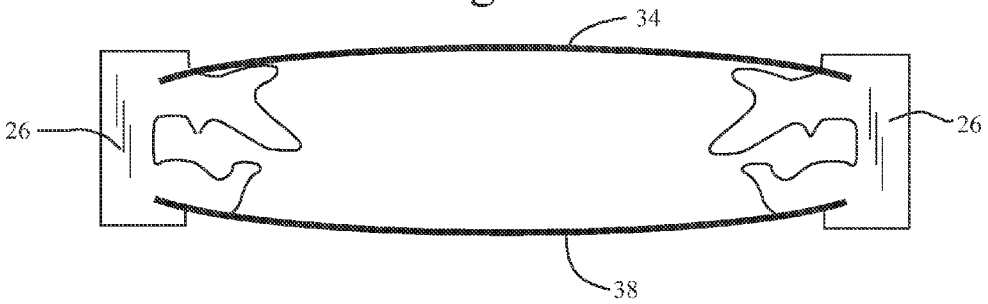
FIG. 3 is side view of two opposing edge protectors and first and second (or third and fourth) cross-members inserted into the two opposing edge protectors.
Figure 7:
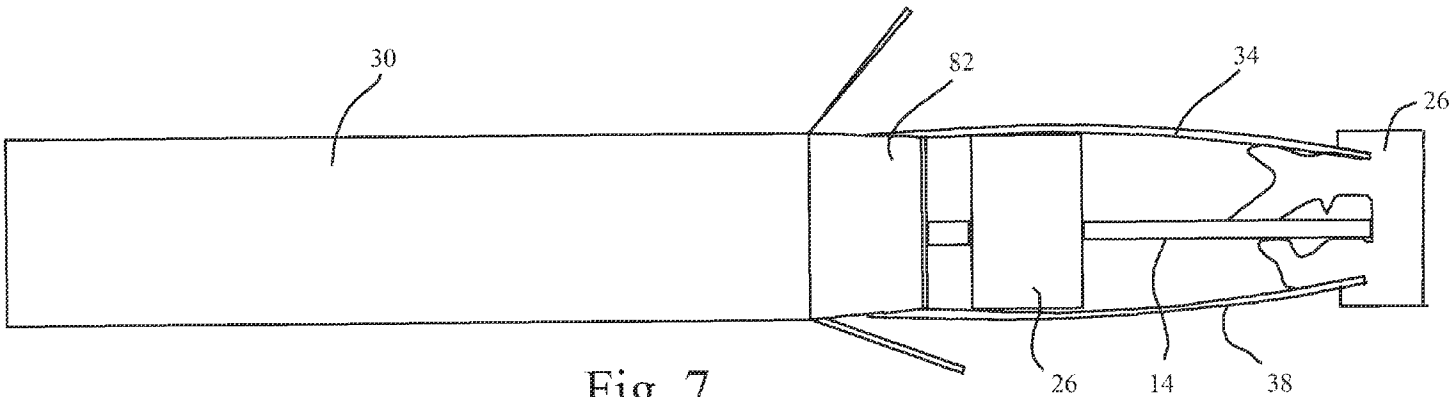
FIG. 7 is a side view of an item being inserted into a box with two opposing edge protectors and a first and second cross-member attached to the opposing edge protectors, and at least one other edge protector also attached to the item.
Figure 6:
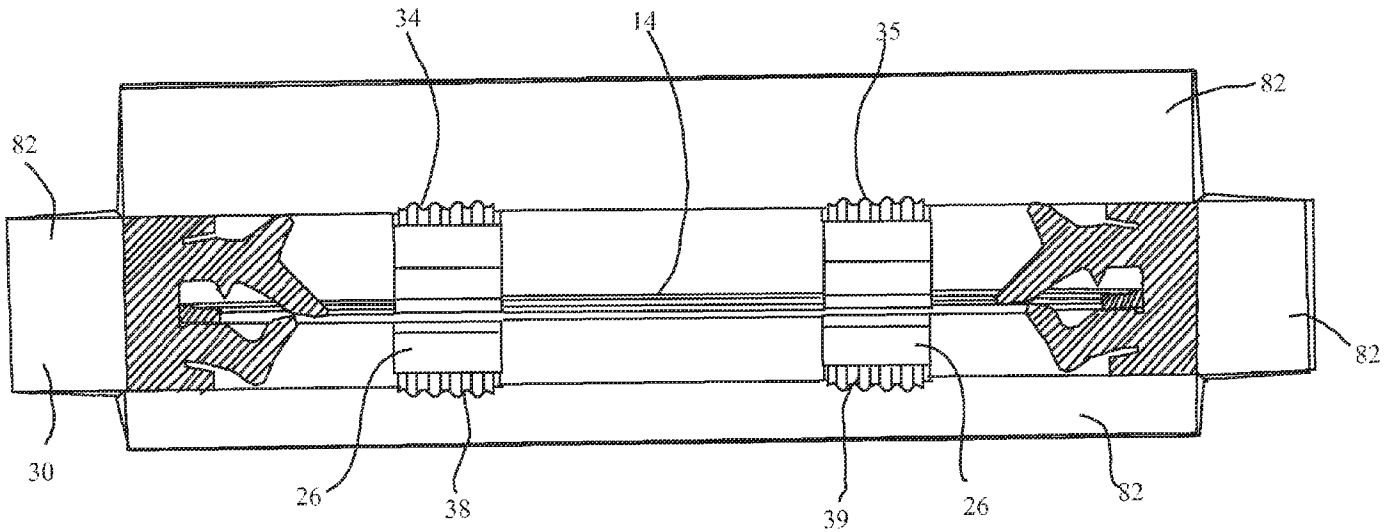
FIG. 6 is a top view of an item inserted in a box with the two pair of opposing edge protectors attached to the item, and two other edge protectors attached to the item.

FIG. 3 shows a side view of two opposing edge protectors 26, 26, and a cross-member 34. FIG. 4 shows a top view of the two opposing edge protectors 26, 26, and a cross-member 34 from FIG. 3. FIG. 5 shows a top perspective view of two opposing edge protectors 26, and cross-members 34, 38. FIG. 6 shows a top view of a first pair of two opposing edge protectors 26 (the first edge protector 26 being the only one visible of the first pair in this view), a first cross-member 34 and a second cross-member 38, a second pair of two opposing edge protectors 26 (the first edge protector 26 being the only one visible of the second pair in this view), a third cross-member 35 and a fourth cross-member 39 and two other edge protectors 26 attached to the item 14 as it is would look inside a box 30 with the box flaps 82 opened. FIG. 7 shows a side view of a box 30 with one opposing edge protector 26 (the other opposing claim shell support 26 is not visible in this view) a first cross-member 34, a second cross-member 38, and one other edge protector 26 attached to the item 14, as the item is being put into a box 30, or taken out of a box 30.

The packaging system is designed to provide a shipping container for the safe transport of fragile items.

The shipping system consists of two, edge protectors 26 that surround the item 14 to be packaged. Two (2) of the edge protectors 26 are connected by two cross-members 34, 38 that are then inserted in a carton or box 30 that is sized to allow for the insertion of the edge protectors 26, cross-members 34, 38, and item 14 being packaged. The cross members 34, 38 will be bowed before it is inserted in the carton. It will flatten as it is inserted in the carton, suspending the fragile item within the carton. On all sides of the carton there will be at least about 2 inches between the interior surface of the box or carton and the item 14.

The bottom of the cardboard box or carton may be secured with packaging tape. The item being shipped will have the edge protectors attached it with the cross-members 34, 38 inserted into two opposing edge protectors 26, and then the item 14 and edge protectors and cross-members 34, 38 will be then be inserted into the open end of the box 30 or carton. After the item 14 and edge protectors 26 and cross-members 34, 38 have been inserted into the box 30, the box flaps will be folded over to close the box 30 and may be secured with packing tape.

The system will provide an about 2 inch space cushion on all sides of the item 14 to be packaged, which can fulfill the requirements of small package regulations.

An additional advantage of the disclosed packaging system is to provide a shipping solution that will be inexpensive, light weight, and easy to assemble. It will provide protection to fragile flat articles of varying dimensions including glass, cork board, and wood.

Briefly stated, the present invention discloses a shipping container comprising a support member and a carton dimensioned to permit insertion of the support member. The support member has a surface face upon which a fragile flat article is fixed. Due to the two inches between the item and the carton, the item 14 is suspended and thus permitted restrained movement within the carton and prevents damage during shipment.

The container is dimensioned to permit the insertion of two support members, each support member having fixed to the surface face a fragile flat item 14, and each support member having corner side walls of a width greater than the thickness of the article when fixed upon the surface face of the support member. For shipping multiple containers, the containers each with a support member and item 14 attached, are placed into a larger additional container which is then shipped to the retailer or distributor. The retailer or distributor then removes the individual shipping containers from the larger container. The retailer or distributor can then use the individual shipping container for shipping the item 14 to its customers.

A variety of fragile articles may be transported via the shipping system described above, fragile materials in the form of flat structures are particularly suitable. For example, glass mirrors, windows, and pieces of art may be shipped by the fragile packaging system.

The system can be modified to handle flat items of any size with a change in the opening size of the end cap. For example, the end caps can accommodate a flat panel television when designed with an opening greater than two inches. The cross-members would be constructed of a thicker, more rigid cardboard to accommodate the additional weight of the object to be transported. Of course, in other embodiments, the cross-member may be constructed of a plastic too.

To provide protection against scratches to an item 14 such as a TV, a layer of protecting wrap may be wrapped around the article prior to being fixed to the surface face of the edge protectors 26.

Once the edge protector 26 is inserted into the carton, the fragile item 14 is capable of restrained movement with the edge protectors 26, due to the energy absorbing nature of the edge protectors 26.

The arc in the cross-members 34, 38 will absorb any shock or pressure that the carton may experience during transport. The item 14 will be secured in middle slot 62 of the edge protector 26. This will allow the item 14 to shift or move slightly within the box 30 during vibration or shocks, rather than to tightly confine the article against movement.

Since items are often shipped by way of a small package delivery companies, the size and strength of the shipping container frequently must meet specific carrier and insurance requirements. Therefore, the shipping container of the present invention may be dimensioned to comply with size requirements, and constructed from suitable materials to comply with strength requirements. A corrugated cardboard having approximately a 275 psi test strength provides a suitable material for construction of both the support member and the carton.

Figure 8:
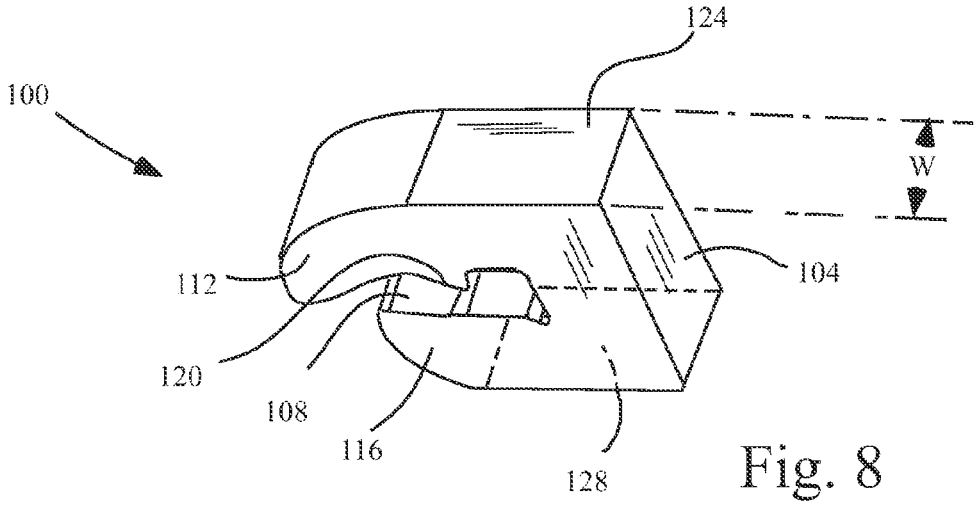
FIG. 8 is a top perspective view of another embodiment of a edge protector.
Figure 9:
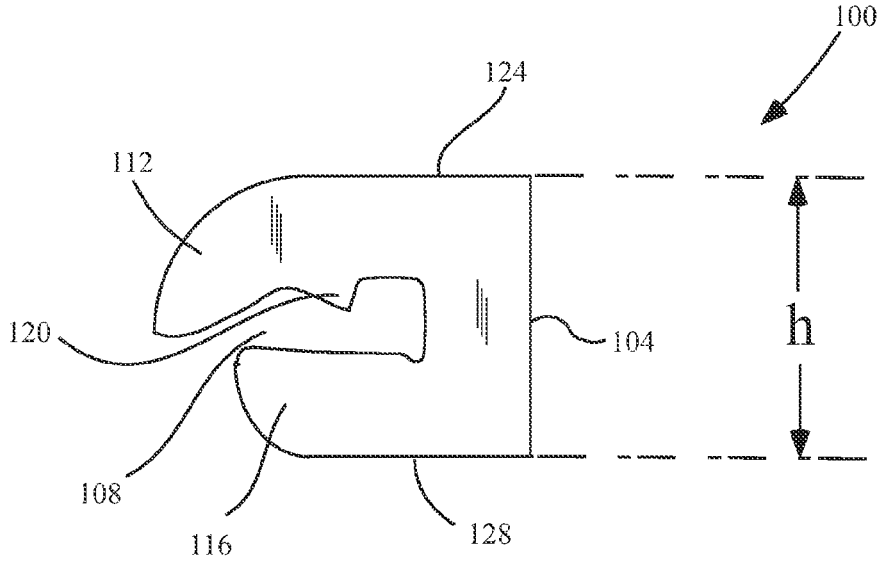
FIG. 9 is a side view of the edge protector from FIG. 8.

FIGS. 8 and 9 disclose another embodiment of a edge protector 100. FIG. 8 is a top perspective view of a edge protector 100, and FIG. 9 is a front view of a edge protector 100. The edge protector 100 comprises a backwall 104, and a single slot 108. The single slot 108 is generally defined by an upper jaw member 112 and a lower jaw member 116, and an upper jaw protruding member 120. The edge protector 100 is a design that is easier and less expensive to manufacture than first embodiment of the edge protector 26 shown in FIGS. 1-7. The top surface 124 and bottom surface 128 of the edge protector 100 is generally flat and generally parallel to each other. In one embodiment, the edge protector may have a height "h" of about 3 inches to about 10 inches, and preferably the edge protectors will available in heights h of about 4, 5, 6, 7 inches. The edge protector may have a width "w" of about ½ inch to about 4 inches, and preferably a width of about 1.9 inches to about 2.1 inches.

Figure 10:
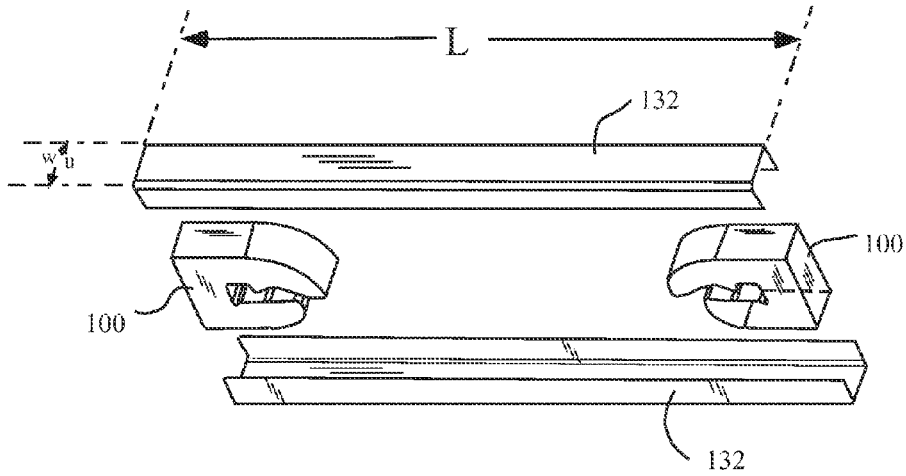
FIG. 10 is a top perspective view of the other embodiment of the edge protector, being used with the u-channel support members.
Figure 11:
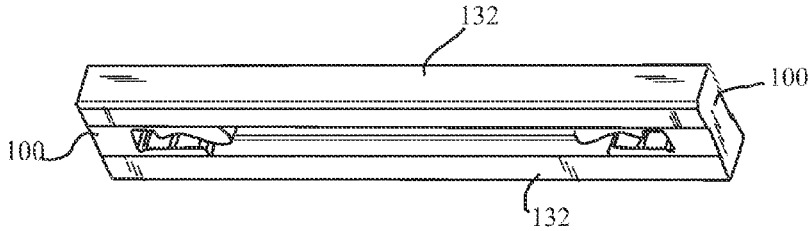
FIG. 11 is a top perspective view of two edge protectors attached to two u-channel support members.
Figure 12:
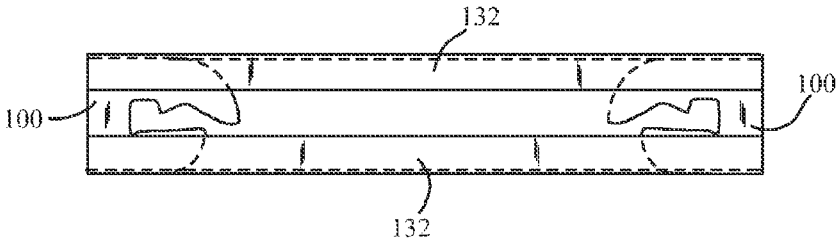
FIG. 12 is a side view of two edge protectors attached to two u-channel support members.
Figure 13:
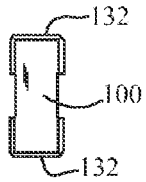
FIG. 13 is a front view of two edge protectors attached to two u-channel support members.

FIG. 10 shows how two edge protectors 100 may be used with one or more u-channel support members 132. The u-channel support members 132 may be of varying lengths, but will generally be sized generally to fit generally snugly within a shipping container or box. FIG. 11 shows how an upper u-channel support member 132 and lower u-channel support member 132 may be coupled to two edge protectors 100. FIG. 12 shows a front view of two u-channel support members 132 removeably or permanently attached to two claim shell supports 100. FIG. 13 shows a side view of two u-channel support members 132 removeably or permanently attached to two claim shell supports 100 (only one of which is visible in this view). The u-channel support members may have a width "$w_u$" of about ½ inches to about 4 inches, and preferably a width of about 1.9 inches to about 2.1 inches. The height of the u-channel support members may range from about 1 inch to about 1.5 inches, dependent upon the size of the edge protector used. The u-channel support member for a 4 inch high edge protector may be about 1 inch by about 2 inches by about 1 inch in dimension. The u-channel support member may be about 1.5 inches by about 2 inches by about 1.5 inches for the a 5 inch high edge protector.

Figure 14:
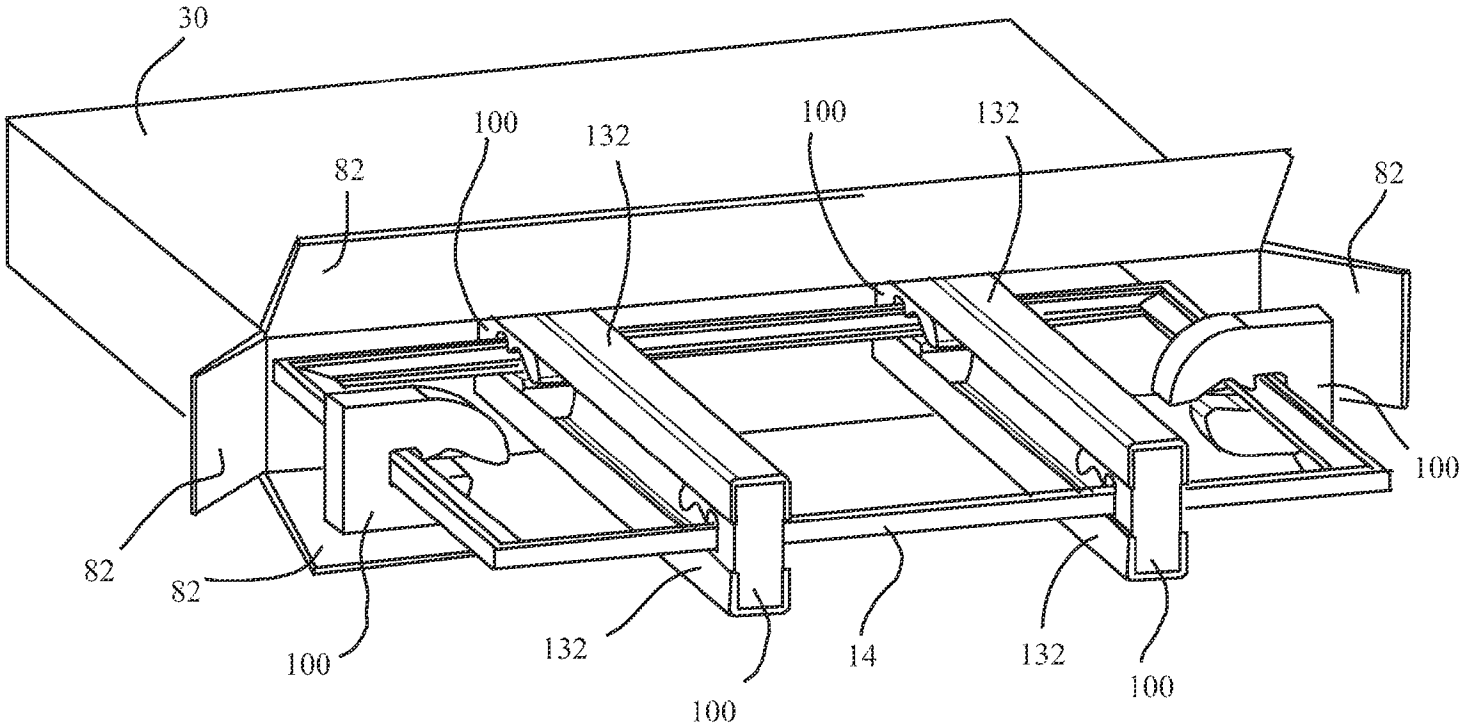
FIG. 14 is a perspective view of several edge protectors attached to an item to be shipped, and a shipping box.
Figure 15:
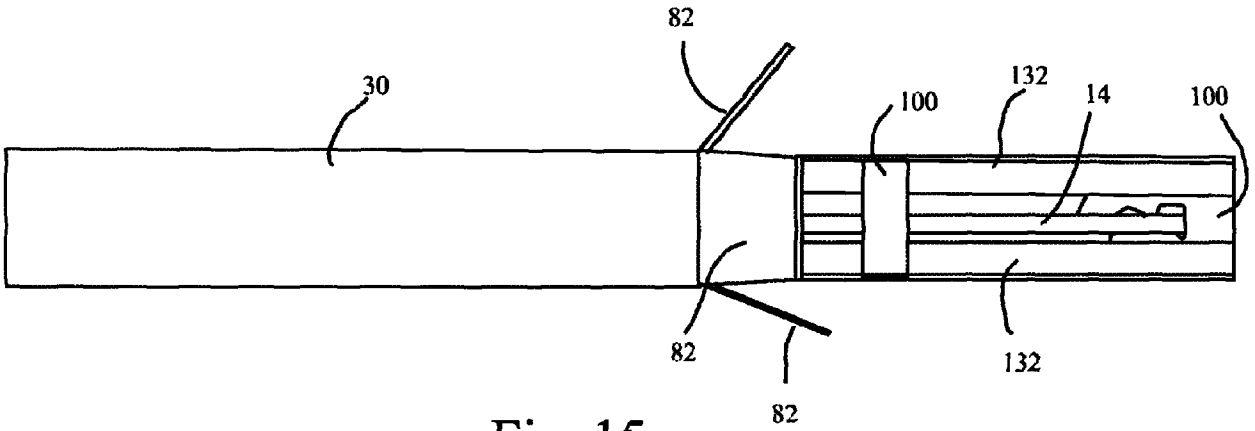
FIG. 15 is a side view of the disclosed system.

FIG. 14 shows how an item 14 may be attached to six edge protectors 100 and four u-channel support members 132 and inserted into a box 30 with open box flaps 82. As shown in this figure, the item 14, which may be a flat panel television, a painting, a picture frame, or any other generally flat item is shown attached to a plurality of edge protectors 100. The single slot 108 is slid over and onto the item 14. The upper jaw protruding member 120 tends to keep the edge protector 100 from backing out from the item 14. Two u-channel support members 132 are attached to a first pair of opposing edge protectors 100, and two other u-channel support members 132 are attached to a second pair of opposing edge protectors 100. FIG. 15 shows a side view of the disclosed system, with the item 14 about ⅓ inside of the box 30.

Figure 16:
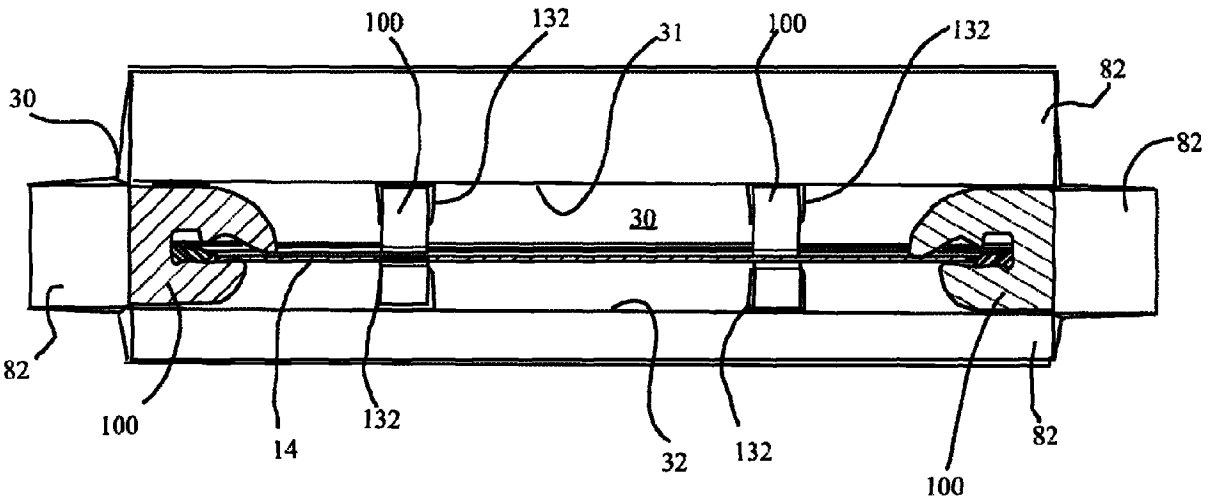
FIG. 16 is a front view of the disclosed system.

FIG. 16 shows a front view of the disclosed system, with the item 14 fully inserted into a box 30, with the box flaps still opened. In this view, it can be seen that the u-channel support members 132 and the edge protectors 100 act in concert to prevent the top surface 31 and bottom surface 32 of the box 30 from impinging and/or otherwise contacting the item 14.

Figure 17:
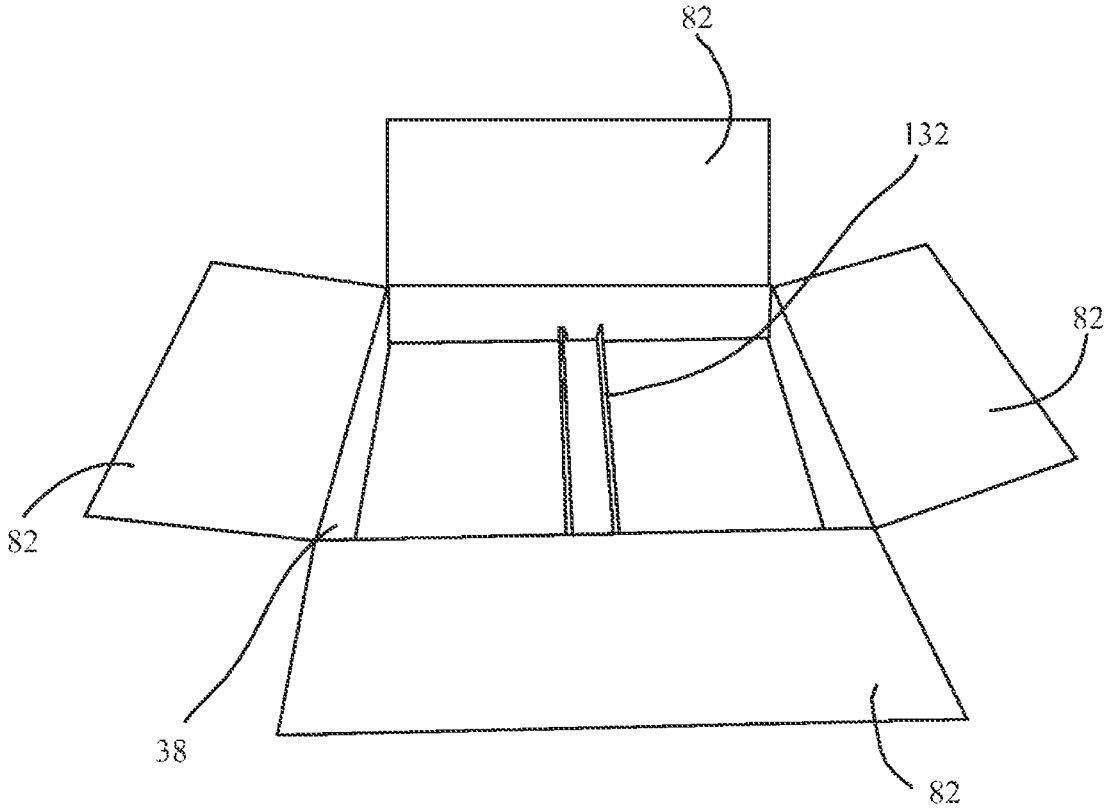
FIG. 17 is a perspective view of another embodiment of the disclosed system.
Figure 18:
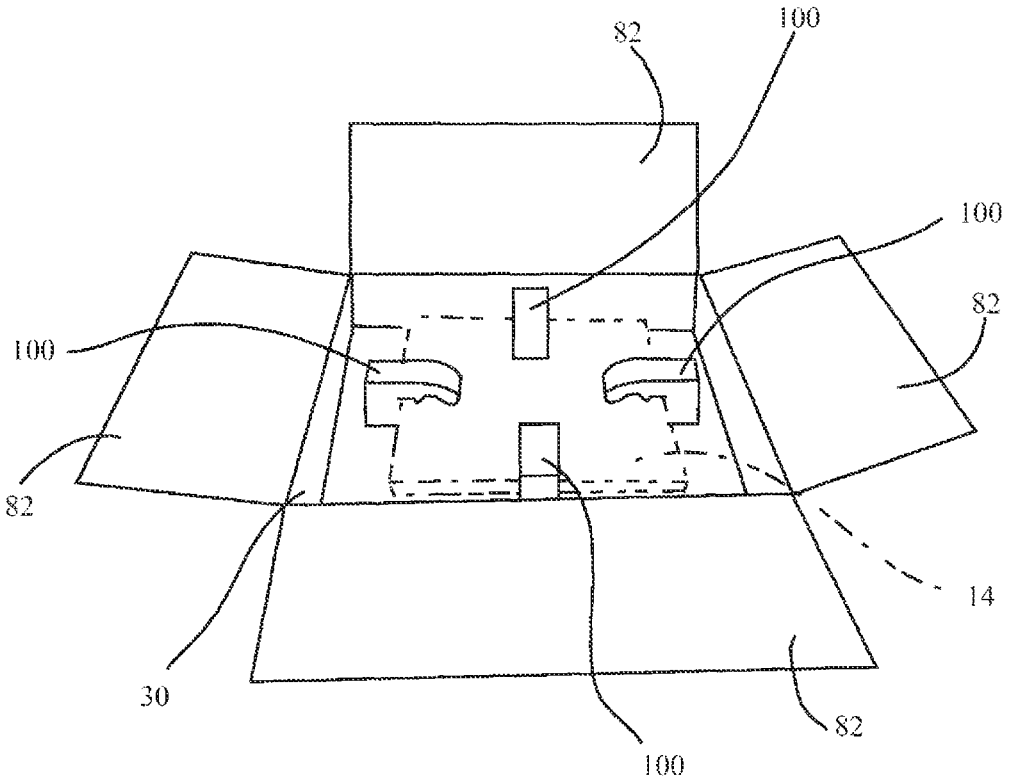
FIG. 18 is a perspective view of the disclosed system from FIG. 17, with the item and 4 edge protectors attached to the item.
Figure 19:
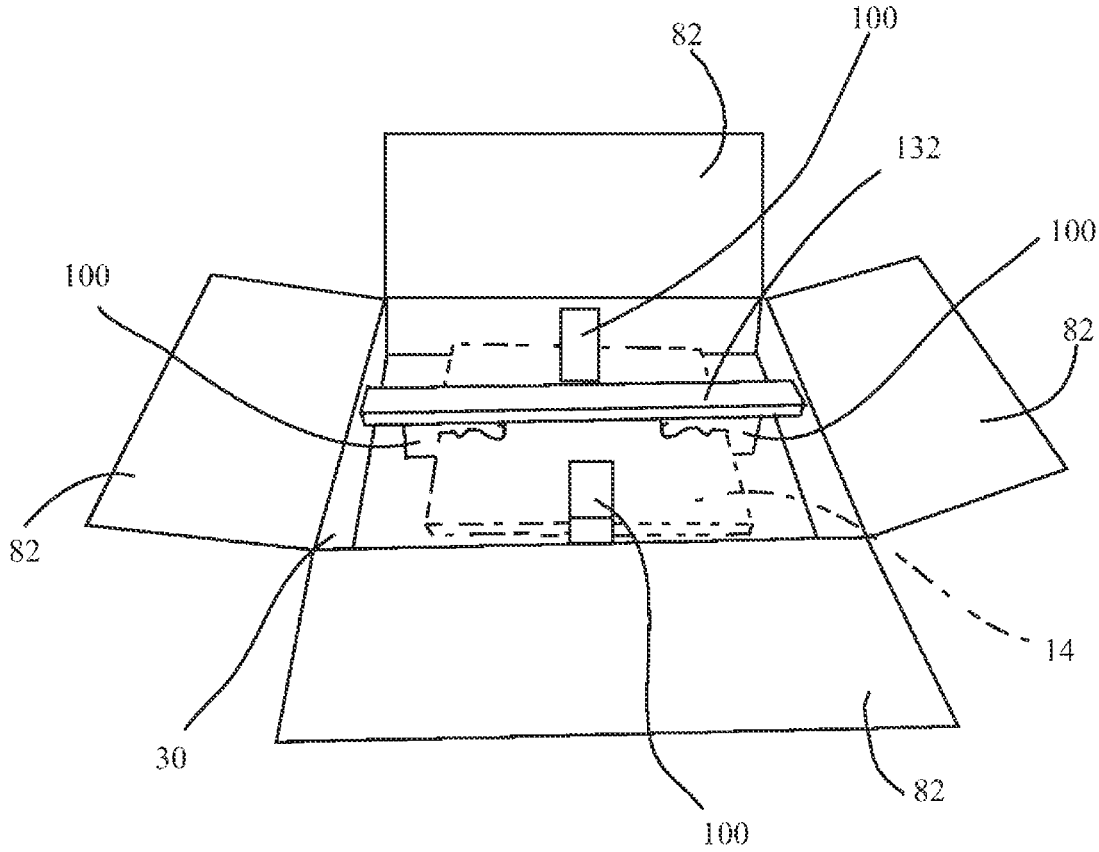
FIG. 19 is a perspective view of the disclosed system from FIG. 18, showing a u-channel support member attached to two edge protectors.

FIG. 17 shows another means of using the disclosed system. A box 30 with open box flaps 82 is shown. In the bottom of the box a u-channel support member 132 is located, with the "u" facing up. An item 14 with four edge protectors 100 is placed in the box, with two of the edge protectors 100 configured so that they will sit in the u-channel support member 132 that is located in the bottom of the box 30. This is shown in FIG. 18. In FIG. 19, a u-channel support member 132 is attached to two edge protectors 100 such that this u-channel support member 132 is generally orthogonal to the u-channel support member 132 located in the bottom of the box 30 (the bottom u-channel support member 132 not visible in FIGS. 18 and 19). In this way, the item 14 is supported in the center of the box 30, when the box flaps 82 are closed, by the four edge protectors 100 and the two orthogonal u-channel support members 132. Also, such an arrangement is relatively quick and easy to set up when shipping items 14, thus reducing shipping costs, while providing a secure and safe means of transporting the item 14.

Figure 20:
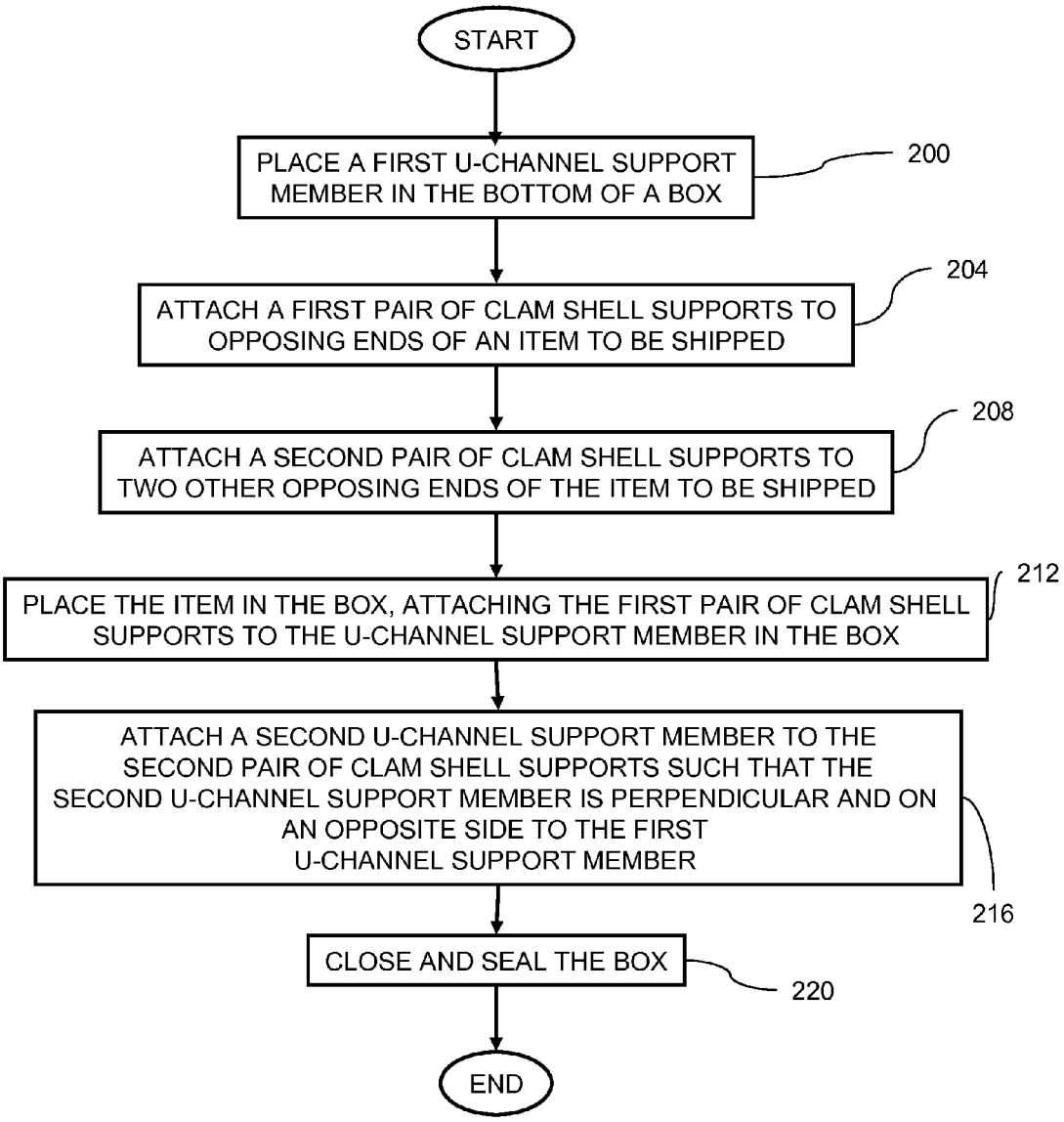
FIG. 20 is a flowchart showing one disclosed method of the invention.

FIG. 20 shows a flowchart that illustrates one method of the disclosed invention. At act 200 a user places a first u-channel in the bottom of a box. At act 204 the user attaches a first pair of edge protectors to opposing ends of an item to be shipped. At act 208, a second pair of edge protectors are attached to two other opposing ends of the item to be shipped. At act 212, the item is placed in the box, and the first pair of edge protectors are attached to the u-channel support member in the box. At act 216, a second u-channel support member is attached to the second pair of edge protectors such that the second u-channel support member is perpendicular to the first u-channel support member and on the opposite side of the item from the first u-channel support member. At act 220, the box is closed and sealed for shipping. Another act may be added to this method, that act may be act 206, where the first and second u-channel support members are cut by the user such that each u-channel support member extends by about 2 inches over the opposing ends of the item (i.e. the u-channel support member is about 4 inches longer in at least one dimension of the item).

Figure 21:
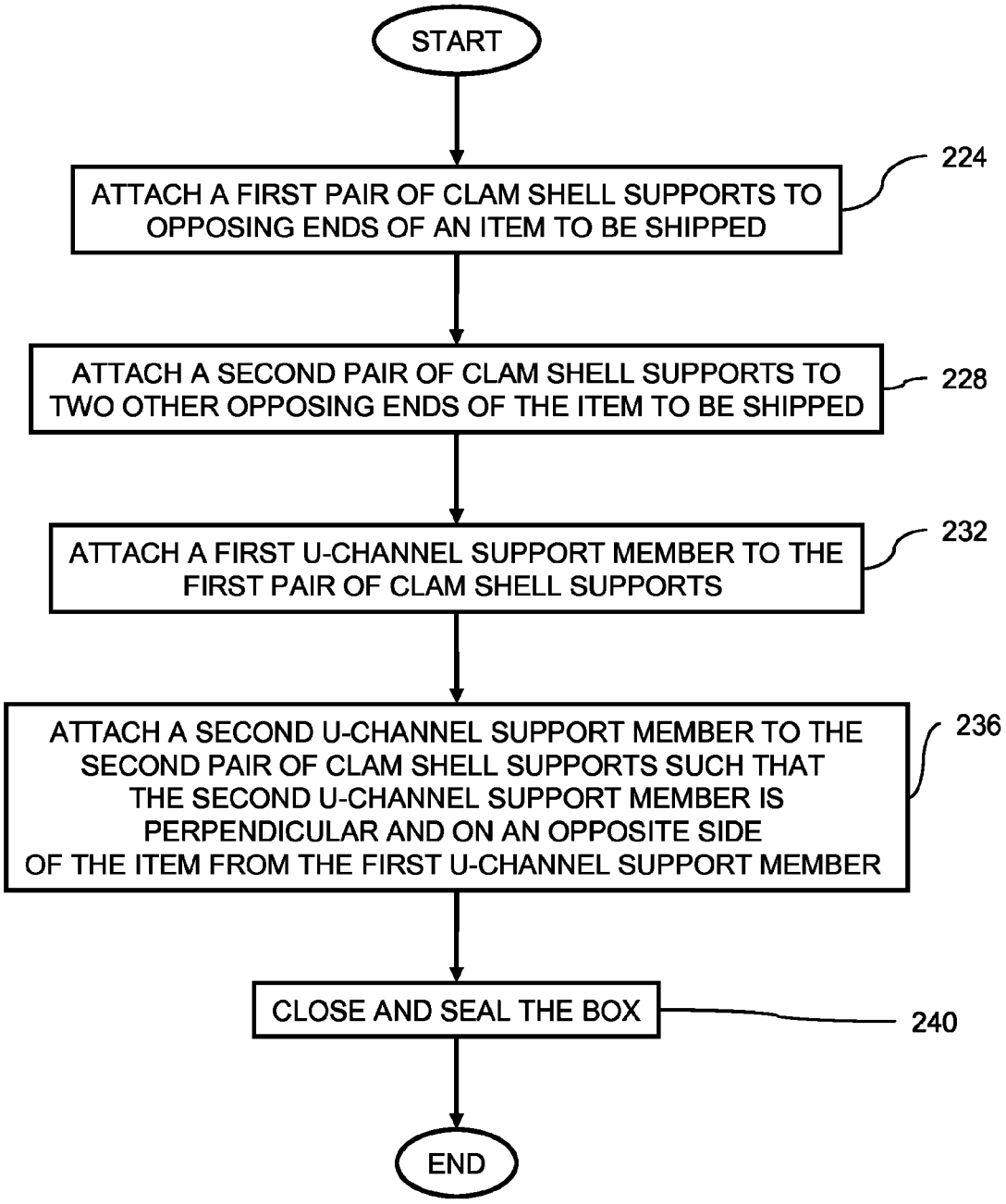
FIG. 21 is a flowchart showing another disclosed method of the invention.

FIG. 21 shows a flowchart that illustrates another method of the disclosed invention. At act 224 a user attaches a first pair of edge protectors to opposing sides of an item to be shipped. At act 228 a user attaches a second pair of edge protectors to two other opposing sides of the item to be shipped. At act 232, a user attaches a first u-channel support member to the first pair of edge protectors. At act 236, a user attaches a second u-channel support member to the second pair of edge protectors such that the second u-channel support member is perpendicular and on an opposite side of the item from the first u-channel support member. At act 240, the box is closed and sealed for shipping. Another act may be added to this method, that act may be act 222, where the first and second u-channel support members are cut by the user such that each u-channel support member extends by about 2 inches over the opposing ends of the item (i.e. the u-channel support member is about 4 inches longer in at least one dimension of the item).

The packaging system is designed to provide a shipping container for the safe transport of fragile items.

The disclosed system may provide about a 2 inch space cushion on all sides of the item 14 to be packaged, which can fulfill the requirements of small package regulations.

An additional advantage of the disclosed packaging system is to provide a shipping solution that will be inexpensive, light weight, and easy to assemble. It will provide protection to fragile flat articles of varying dimensions including glass, cork board, and wood. Briefly stated, the present invention discloses a shipping container comprising a edge protector and a box, container or carton dimensioned to permit insertion of the edge protector. The edge protector has a slot where the flat item may be attached. Due to the two inches between the item and the carton, the item 14 is suspended and thus permitted restrained in movement within the carton and thereby preventing damage to the item during shipment. The box 30 or container is dimensioned to permit the insertion of two edge protectors, each edge protector having attached to the slot a fragile flat item 14, and each edge protector having a height greater than the thickness of the item. For shipping multiple containers, each container with a edge protector and item 14 attached, are placed into a larger additional container which may be shipped to a retailer or a distributor. The retailer or distributor may then remove the individual shipping containers from the larger container. The retailer or distributor can then use the individual shipping container for shipping the item 14 to its customers.

A variety of fragile articles may be transported via the shipping system described above, fragile materials in the form of flat structures are particularly suitable. For example, glass mirrors, windows, pieces of art, flat screen televisions, and flat screen monitors or any flat, item may be shipped by using the fragile packaging system.

The system can be modified to handle flat items of any size with a change in the slot opening size of the edge protector. For example, the edge protectors may accommodate a flat panel television when designed with an opening greater than two inches. The u-channel support members may be constructed of a thicker, rigid plastic to accommodate the additional weight of the object to be transported, as opposed to using cardboard.

To provide protection against scratches to an item 14 such as a TV, a layer of protecting wrap may be wrapped around the item prior to being attached to the edge protectors 26, 100.

Once the edge protector 26, 100 is inserted into the box, container, or carton, the fragile item 14 is capable of restrained movement with the edge protectors 26, 100, due to the springy nature of the edge protectors 26, 100.

Since items are often shipped by way of a small package delivery companies, the size and strength of the shipping container frequently must meet specific carrier and insurance requirements. Therefore, the shipping container of the present invention may be dimensioned to comply with size requirements, and constructed from suitable materials to comply with strength requirements. A corrugated cardboard having approximately a 275 psi test strength provides a suitable material for construction of both the edge protector and the carton.

The u-channel support member is designed to be a relatively rigid non bending structure. This structure supports the cardboard carton from coming in contact with the item that is being transported. The u-channel support member should be cut two inches greater than the length and width of the flat item. If the carton is greater than four inches larger than the length and/or width of the item being shipped, then the u-channel support member is cut to fit the carton size. This keeps the item safely centered in the carton.

The edge protectors may be made from polyethylene foam. The foam is non abrasive, impact resistance, and elastomeric. They act as spacers supporting the item to be shipped and the u-channel support member and absorbing impact. The slots of the edge protectors can be configured to be smaller or larger dependent upon the object being transported. The upper jaw protruding member of the edge protector helps in keeping the edge protector from moving with respect to the item being shipped.

The purpose of the system is to prevent direct contact between the shipping container and a fragile item. Other packaging systems such as bubble wrap, peanuts, and paper are unable to prevent the transmission of force or impact to the protected item.

The Fragile Packaging System can also be used to safely transport all flat items including large flat screen televisions, monitors, windows, doors, mirrors, etc.

In the case where there is more than one item 14 being shipped in one carton, each item may be protected with four edge protectors. The items 14 may then be stacked on top of one another with a u-channel support member being placed on the first and last item being protected. The items being shipped in this manner should all be generally the same size. This will keep all of the edge protectors square against the carton and the items safe from damage.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A shipping system comprising:

a plurality of edge protectors, each of the edge protectors comprising:

a backwall;

an upper jaw member in communication with the backwall, the upper jaw member having a top surface;

a lower jaw member in communication with the backwall, the lower jaw member having a lower surface, and the lower surface and the top surface are generally flat and parallel to each other;

a single slot defined by the upper jaw member and the lower jaw member, and the single slot being generally orthogonal to the backwall, the edge protector having an outer width;

at least one u-channel support member, the u-channel support member comprising:

a bottom wall;

a first sidewall extending generally orthogonally from the bottom wall;

a second sidewall extending generally orthogonally from the bottom wall;

an interior width between an interior surface of the first sidewall and the interior surface of the second sidewall, and where the interior width is generally equal to the outer width.

2. The shipping system of claim 1, further comprising:

a shipping container.

3. The shipping system of claim 1, where the edge protector has a height of about 3 to about 10 inches, a width of about ½ inch to about 4 inches, and where the u-channel support has a width of about ½ inch to about 4 inches.

4. The shipping system of claim 1, where the edge protector has a height of about 4 inches, a width of about 2 inches, and where the u-channel support has a width of about 2 inches.

5. The shipping system of claim 1, where the edge protector is made out of polyethylene foam.

6. The shipping system of claim 1, where the u-channel support members are made from corrugated cardboard with a psi test strength of about 275 psi.

* * * * *